US009968128B2

(12) United States Patent
Alfawaz et al.

(10) Patent No.: US 9,968,128 B2
(45) Date of Patent: May 15, 2018

(54) WATERPIPE AND PORTIONS THEREOF OR ACCESSORIES THEREFOR

(71) Applicant: Healthy Hookah, LLC, Covina, CA (US)

(72) Inventors: Abdalla Alfawaz, Anaheim, CA (US); Ayman Abdel Nour, Covina, CA (US)

(73) Assignee: Healthy Hookah, LLC, Covina, CA (US)

( * ) Notice: Subject to any disclaimer, the term of this patent is extended or adjusted under 35 U.S.C. 154(b) by 118 days.

(21) Appl. No.: 14/960,122

(22) Filed: Dec. 4, 2015

(65) Prior Publication Data

US 2016/0157520 A1 Jun. 9, 2016

Related U.S. Application Data

(60) Provisional application No. 62/087,715, filed on Dec. 4, 2014.

(51) Int. Cl.

| | |
|---|---|
| ***A24F 1/30*** | (2006.01) |
| ***A24F 5/00*** | (2006.01) |
| ***A24F 5/04*** | (2006.01) |
| ***A24D 1/14*** | (2006.01) |

(52) U.S. Cl.

CPC ..... *A24F 1/30* (2013.01); *A24D 1/14* (2013.01); *A24F 5/00* (2013.01); *A24F 5/04* (2013.01)

(58) Field of Classification Search

CPC ..... A24F 1/30; A24F 5/00
USPC ..... 131/173
See application file for complete search history.

(56) References Cited

U.S. PATENT DOCUMENTS

| | | | | |
|---|---|---|---|---|
| 722,405 | A | 3/1903 | Ganim | |
| 4,020,853 | A * | 5/1977 | Nuttall | A24F 1/22 131/195 |
| 5,080,114 | A * | 1/1992 | Rudolph | A24F 47/004 131/194 |
| 2010/0242973 | A1* | 9/2010 | Mehio | A24F 1/30 131/173 |

(Continued)

FOREIGN PATENT DOCUMENTS

| | | | | |
|---|---|---|---|---|
| EP | 2719294 | A1 * | 4/2014 | A24D 1/14 |

OTHER PUBLICATIONS

Machine translation of EP-2719294-A1 (Year: 2014).*

*Primary Examiner* — Eric Yaary
*Assistant Examiner* — Russell E Sparks
(74) *Attorney, Agent, or Firm* — Knobbe, Martens, Olson & Bear, LLP

(57) ABSTRACT

A waterpipe arrangement that, in at least some configurations, is used with a water-based flavored substance instead of tobacco or other substances. In some configurations, the perforated foil has perforations in an annular arrangement configured to reduce, minimize or prevent coal ash from being introduced into the vapor consumed by the user. In some configurations, the consumable vapor-producing substance is in the form of a gel and can be provided in individual packaging. The individual packaging can be configured for placement directly into a receptacle of the bowl of the waterpipe. In some configurations, a single-use or disposable bowl is provided containing a consumable vapor-producing substance. The present disclosure also involves a pre-perforated foil or screen or a tool for perforating a foil.

8 Claims, 14 Drawing Sheets

(56) References Cited

U.S. PATENT DOCUMENTS

| | | | | |
|---|---|---|---|---|
| 2012/0111345 | A1* | 5/2012 | Sweitzer | A24F 1/30<br>131/173 |
| 2014/0061073 | A1* | 3/2014 | Haidar | A24F 23/00<br>206/256 |
| 2015/0075544 | A1* | 3/2015 | Portz | A24D 1/14<br>131/328 |

* cited by examiner

WATERPIPE AND PORTIONS THEREOF OR ACCESSORIES THEREFOR

INCORPORATION BY REFERENCE TO ANY PRIORITY APPLICATIONS

Any and all applications for which a foreign or domestic priority claim is identified in the Application Data Sheet as filed with the present application are hereby incorporated by reference and made a part of the present disclosure.

BACKGROUND

Field

The present disclosure relates to waterpipes, hookahs or shishas and related sub-assemblies, components and other items.

Description of the Related Art

Waterpipes, hookahs or shishas have long been used for smoking tobacco, including flavored tobacco, and other substances. Tobacco or another substance is placed within the bowl of the waterpipe, which is then covered with a perforated foil or screen. Heated coals are placed on the foil or screen to heat the tobacco. Hot air heated by the coals is pulled through the tobacco when a user inhales on the hose of the waterpipe and draws tobacco smoke into the base. The smoke passes through water in the base and then into the tube to the user. In existing arrangements, coal ash can be introduced into the tobacco and, thus, into the smoke consumed by the user.

SUMMARY

The present disclosure involves an improved or alternative waterpipe arrangement, which in at least some configurations is used with a water-based flavored substance instead of tobacco or other substances. Thus, a flavored water vapor is consumed by the user instead of tobacco smoke or smoke from another combustible substance. In some configurations, the perforated foil is configured to reduce, minimize or prevent coal ash from being introduced into the vapor consumed by the user. In some configurations, the consumable vapor-producing substance is in the form of a gel and can be provided in individual packaging. The individual packaging can be configured for placement directly into a receptacle of the bowl of the waterpipe. In some configurations, a single-use or disposable bowl is provided containing a consumable vapor-producing substance. The present disclosure also involves a pre-perforated foil or screen or a tool for perforating a foil.

The systems, methods and devices described herein have innovative aspects, no single one of which is indispensable or solely responsible for their desirable attributes. Without limiting the scope of the claims, some of the advantageous features will now be summarized.

In some configurations, a waterpipe assembly comprises a base defining an interior space that holds a volume of water. A stem extends upwardly from the base and defines an interior passage. A hose communicates with the interior space of the base above a level of the water. A bowl is located at an upper end of the stem. The bowl has an interior space communicating with the passage of the stem. The bowl defines a support surface. A vapor-producing substance is held within a container that is supported by the support surface. The container is spaced from an upper end of the bowl. A screen covers the upper end of the bowl. At least one charcoal piece is positioned on the screen to supply heat to the vapor-producing substance within the container.

In some configurations, the bowl comprises an interior wall spaced below the upper end of the bowl and defining the support surface.

In some configurations, the interior wall defines an opening that receives the container of the vapor-producing substance.

In some configurations, the bowl further comprises a gutter that surrounds the opening.

In some configurations, the bowl further comprises transfer ports that permit gases to pass from one side of the interior wall to the other side of the interior wall with the container in place within the opening.

In some configurations, the screen is a foil sheet having a plurality of perforations arranged in an annular pattern such that a central portion of the foil sheet does not include perforations.

In some configurations, a bowl for a waterpipe comprises an outer wall portion extending between an open lower end and an open upper end of the bowl. An interior wall portion extends inwardly from the outer wall portion. The interior wall portion is spaced from the open upper end of the bowl and defines an opening configured to receive a container containing a vapor-producing substance such that the interior wall portion supports the container within the bowl at a location spaced from the open upper end. One or more transfer ports are configured to permit gases to pass from above the interior wall portion to below the interior wall portion when the container is in place within the opening.

In some configurations, the transfer ports extend into and are contiguous with the opening.

In some configurations, a gutter surrounds the opening.

In some configurations, the gutter is adjacent the outer wall portion.

In some configurations, a disposable bowl for a waterpipe comprises an outer wall portion extending between an open lower end and an open upper end of the bowl. An interior wall portion extends inwardly from the outer wall portion. The interior wall portion comprises a receptacle containing a vapor-producing substance. The receptacle and the substance are spaced from the open upper end of the bowl. One or more transfer ports permit gases to pass from above the interior wall portion to below the interior wall portion when the container is in place within the opening. A first removable closure closes the open upper end and a second removable closure closes the open lower end.

In some configurations, a perforated screen extends above the receptacle.

In some configurations, a gutter surrounds the opening.

In some configurations, the gutter is adjacent the receptacle.

In some configurations, a disposable capsule for use with a waterpipe comprises a container. A water-vapor-producing gel is within the container. The gel comprises a flavoring. A removable closure closes an opening of the container.

In some configurations, the container is constructed from a coated aluminum material.

In some configurations, a tool for piercing a foil for use with a waterpipe comprises a base. A handle extends from the base. A plurality of spikes extends from an opposite side of the base from the handle. The plurality of spikes are provided in an annular arrangement such that the tool comprises a central portion without spikes.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
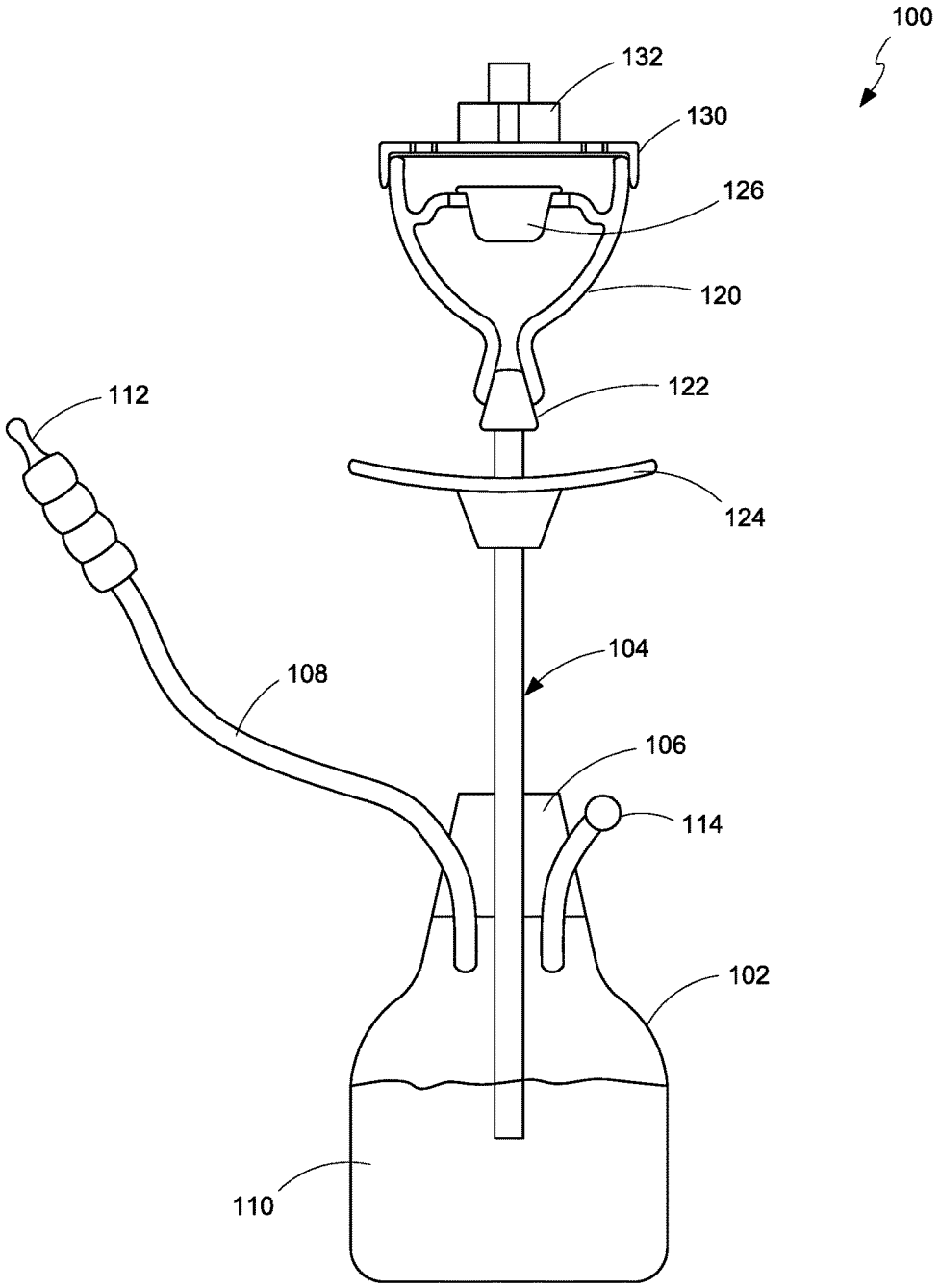
FIG. 1 is a partial sectional view of a waterpipe, hookah or shisha having certain features, aspects and advantages of the present disclosure.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIG. 1 illustrates a waterpipe, hookah or shisha 100 having certain features, aspects and advantages of the present disclosure. In some configurations, as described herein, portions or components of the waterpipe 100 are standard or of a conventional or otherwise suitable arrangement. The illustrated waterpipe 100 includes a base, vase or jar 102. A body, shaft or stem 104 is supported relative to the base 102 by a base gasket or grommet 106, which also closes the open top of the base 102. A first end of a hose 108 communicates with an interior of the base 102 at a location above the level of the water 110 within the base 102. A second end of the hose 108 is external of the base 102 and includes a tip 112 that allows a user to inhale vapor from the interior of the base 102. In some configurations, a purge valve 114 communicates with an interior of the base 102 and includes a one-way valve that permits gas to escape the interior of the base 102 when the pressure within the base 102 rises above the ambient or surrounding pressure. For example, a user can blow into the hose 108 to increase the pressure within the base 102 and purge the gas within the base 102 through the purge valve 114. However, in some configurations, the waterpipe 100 is used to vaporize non-tobacco or water vapor-producing substances such that purging of base 102 may not be necessary.

A bowl 120 is supported at an upper end of the stem 104 by a bowl gasket or grommet 122. If desired, a plate or tray 124 can be supported by the stem 104 at a position below the bowl 120. An interior space of the bowl 120 communicates with an interior of the hollow stem 104 at an upper end and a lower end of the stem 104 is positioned within the base 102 below the level of the water 110. Thus, gas and/or vapor in the bowl 120 passes through the stem 104, through the water 110 in the form of or within bubbles and then through the hose 108 to the user. The bowl 120 contains a vapor-producing substance within an interior of the bowl 120. In the illustrated embodiment, the vapor-producing substance is held in a container 126 that is supported within an interior space of the bowl 120. Preferably, as described further below, the container 126 is spaced from an upper end of the bowl 120.

A screen, such as a perforated foil sheet 130, is placed over the open upper end of the bowl 120 and supports one or more pieces of charcoal 132, which heats the air within the bowl 120. The heated air within the bowl vaporizes the vapor-producing substance within the container 126. In some configurations, the vapor-producing substance is in the form of a water-containing gel, which can also include flavor and/or odor-producing substances. Thus, rather than smoke from the combustion of tobacco or other similar substances, a user of the illustrated waterpipe 100 inhales water vapor, which can include a flavoring.

In use, the waterpipe 100 is assembled as illustrated, if necessary. Coals 132 are heated and placed onto the perforated foil 130 to heat the air within the bowl 120 and vaporize the vapor-producing substance within the container 126. A user of the waterpipe 100 inhales air from the base 102 through the hose 108, which draws air from the bowl 120 through the stem 104, through the water 110 and into the interior of the base 102 to be consumed by the user. This process can be repeated as desired. Air is drawn into the bowl 120 through perforations or holes 134 in the perforated foil 130. In some configurations, the holes 134 are located along or near the periphery of the foil 130 or along or near the periphery of the bowl 120. As a result, a center portion of the foil 130 is solid to inhibit coal ash from the charcoal 132 from entering the bowl 120.

Figure 3:
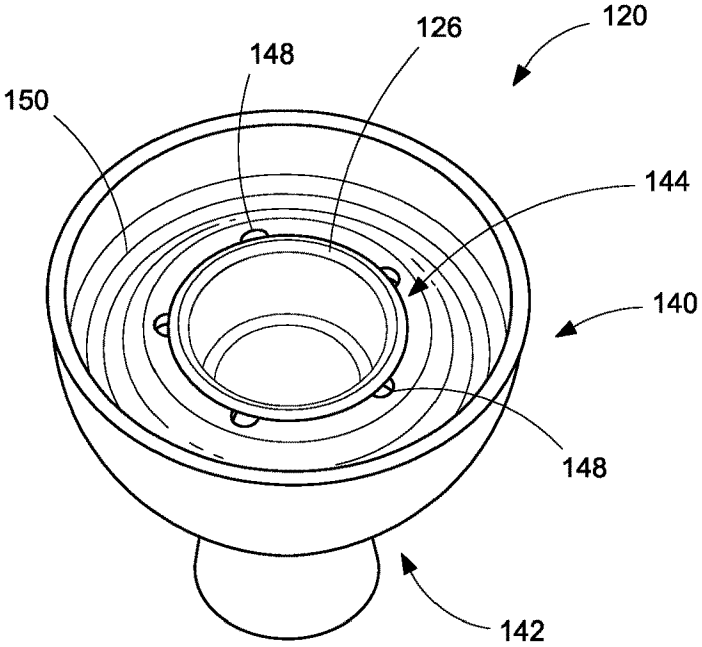
FIG. 3 is a perspective view of the bowl of FIG. 2 with the vapor-producing substance container positioned in the bowl.
Figure 2:
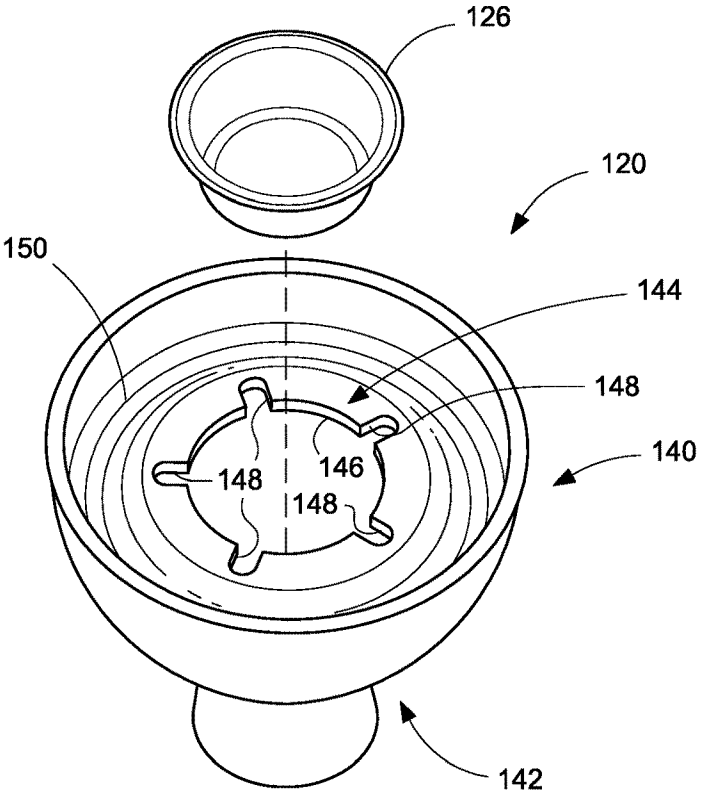
FIG. 2 is a perspective view of a bowl for the waterpipe of FIG. 1 with a vapor-producing substance container separated from the bowl.

With reference to FIGS. 2 and 3, a first embodiment of a bowl 120 is illustrated with the vapor-producing substance container 126 in place within the bowl 120 and removed from the bowl 120, respectively. The illustrated bowl 120 has an open upper end and an open lower end and includes a sidewall that defines an upper bowl portion 140 and a lower stem portion 142. The lower stem portion 142 of the bowl 120 couples to the upper end of the stem 104. As described above, the open upper end of the bowl 120 can be covered with a screen, such as perforated foil 130, which can support coals 132.

An interior wall 144 extends at least partially across the hollow interior of the bowl 120 in a direction generally transverse to a longitudinal axis of the sidewall or hollow interior of the bowl 120. The interior wall 144 originates at the outer sidewall of the bowl 120 and extends toward a central opening 146 that is sized to receive the vapor-producing substance container 126. Preferably, the opening 146 is sized such that the interior wall 144 supports an upper portion, such as a rim or lip, of the container 126. An upper surface of the interior wall 144 is positioned below the open upper end of the bowl 120 (within the bowl 120) such that the vapor-producing substance container 126 is spaced below the open upper end of the bowl 120. As a result, the vapor-producing substance container 126 is spaced from the charcoal 132 held by the perforated foil 130.

The interior wall 144 also includes one or more vents or transfer ports 148 that permit gases to pass from one side of (e.g., above) the interior wall 144 to the other side of (e.g., below) the interior wall 144. The transfer ports 148 are sized or shaped to permit the passage of gases past the interior wall 144 when the vapor-producing substance container 126 is in place within the opening 146. In the illustrated arrangement, the transfer ports 148 extend from and are contiguous with the opening 146. In some configurations, the portion of the interior wall 144 that includes the transfer ports 148 is substantially planar thereby creating a suitable surface for supporting the vapor-producing substance container 126. Although transfer ports 148 are illustrated, other suitable arrangements for permitting gases to pass through the interior wall 144 can also be used. For example, one or more protrusions could hold the rim or lip of the vapor-producing substance container 126 above the surface of the interior wall 144 and the opening 146 can be sized to create a gap with the container 126. Alternatively, the ports 148 can be replaced with depressions instead of through-holes.

The interior wall 144 also defines a depression or recess, such as a gutter 150, that can collect coal ash or other sediment carried by air or gases moving through the bowl 120. The illustrated gutter 150 is annular in shape and surrounds the opening 146. In some configurations, the gutter 150 is adjacent the sidewall of the bowl 120. In cross-section, the gutter 150 can be of any suitable shape or depth. In the illustrated arrangement, the gutter 150 is U-shaped in cross-sectional shape, which can eliminate corners and facilitate cleaning.

Figure 5:
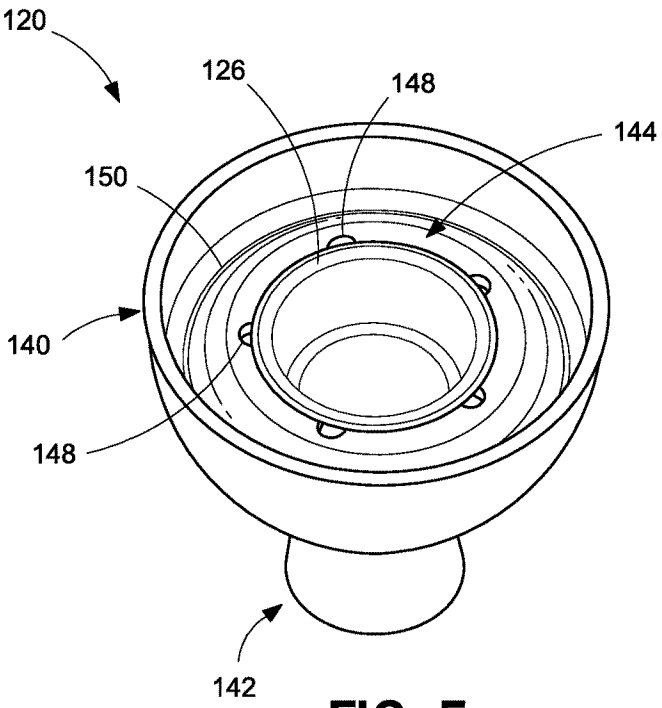
FIG. 5 is a perspective view of the bowl of FIG. 4 with the vapor-producing substance container positioned in the bowl.
Figure 4:
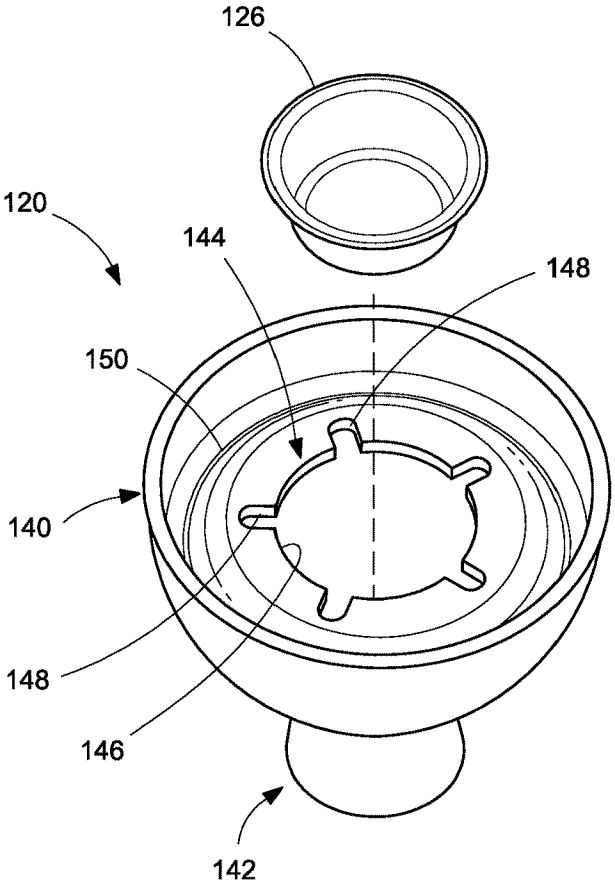
FIG. 4 is a perspective view of another bowl for the waterpipe of FIG. 1 with a vapor-producing substance container separated from the bowl. The bowl of FIG. 4 has a smaller diameter than the bowl of FIGS. 2 and 3, but is otherwise similar in shape.

FIGS. 4 and 5 illustrate another embodiment of a bowl 120, which is substantially similar to the bowl 120 of FIGS. 2 and 3. For example, the bowl 120 of FIGS. 4 and 5 is substantially the same shape as the bowl 120 of FIGS. 2 and 3. The bowl 120 of FIGS. 4 and 5 includes an interior wall 144 having an opening 146 and transfer ports 148. However, the diameter of the bowl 120 of FIGS. 4 and 5 is somewhat smaller than the diameter of corresponding portions of the bowl 120 of FIGS. 2 and 3. In addition, the width of the gutter 150 in the bowl 120 of FIGS. 4 and 5 is somewhat narrower than the gutter 150 of the bowl 120 of FIGS. 2 and 3. The gutter 150 in FIGS. 4 and 5 is substantially semi-circular in cross-sectional shape.

Figure 6:
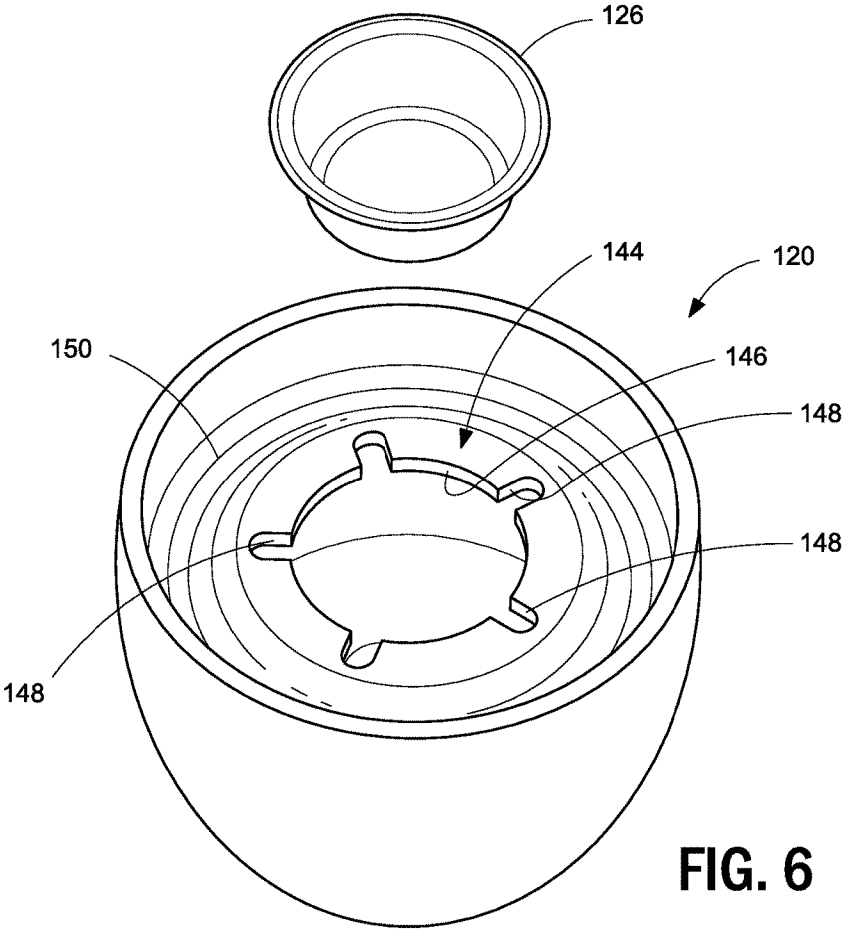
FIG. 6 is a perspective view of yet another bowl for the waterpipe of FIG. 1 with a vapor-producing substance container separated from the bowl. The bowl of FIG. 6 has a different shape than the bowl of FIGS. 2-5.
Figure 7:
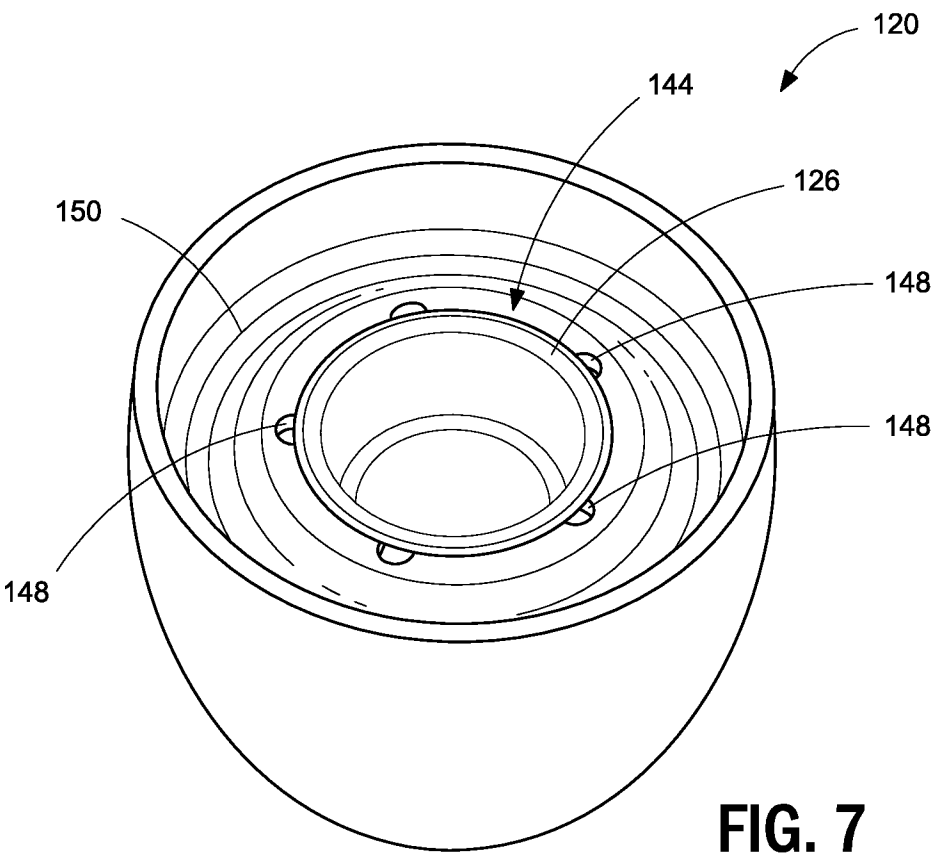
FIG. 7 is a perspective view of the bowl of FIG. 6 with the vapor-producing substance container positioned in the bowl.

FIGS. 6 and 7 illustrate yet another embodiment of a bowl 120, which is substantially similar to the bowl 120 of FIGS. 2 and 3 and the bowl 120 of FIGS. 3 and 4. The bowl 120 of FIGS. 4 and 5 includes an interior wall 144 having an opening 146 and transfer ports 148. However, the outer shape of the bowl 120 of FIGS. 6 and 7 is different than the shape of the prior bowls 120. For example, the bowl 120 of FIGS. 6 and 7 does not include a lower stem portion 142. The sidewall of the bowl 120 of FIGS. 6 and 7 increases in diameter (or cross-sectional dimension for other shapes) from a lower open end to an upper open end. As in the prior bowls 120, the upper surface of the interior wall 144 is spaced below the open upper end. In other respects, the bowl 120 is substantially the same as the prior bowls. The bowls 120 can be constructed of any suitable material, such as ceramic, for example.

Figure 8:
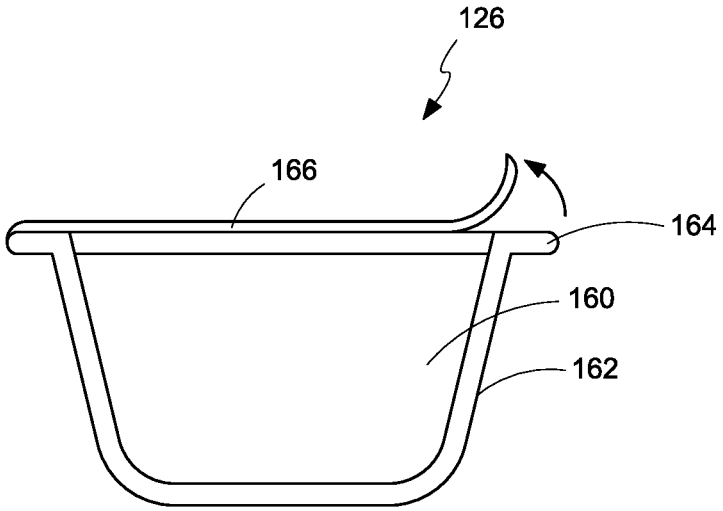
FIG. 8 is a sectional view of a vapor-producing substance container.

FIG. 8 illustrates an embodiment of the vapor-producing substance container 126 having a vapor-producing substance 160 contained therein. The container 126 can include a bowl-like base 162 comprising a rim or lip 164 defining an open upper end and a removable sealing layer 166 that closes and seals the open upper end of the base 162. As described above, the base 162 is sized and shaped to be received within the opening 146 of the bowl 120 with the rim 164 resting on the interior wall 144.

The vapor-producing substance 160 is configured to be vaporized by the charcoal 132 or other heat source. A session of use of the vapor-producing substance 160 can last for up to several hours. Accordingly, in at least some configurations, the base 162 is configured to withstand the heat produced by the charcoal 132 or other heat source for at least a period of several hours. In some configurations, the base 162 is constructed from an aluminum material, which can be a coated aluminum material. Other suitable materials can also be used. The sealing layer 166 can be constructed from a foil material, or other suitable material.

Figure 9:
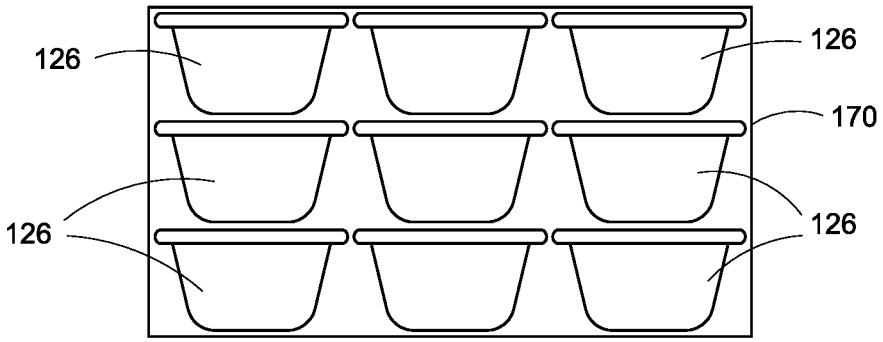
FIG. 9 is a sectional view of a multi-pack of vapor-producing substance containers of FIG. 8.
Figure 17:
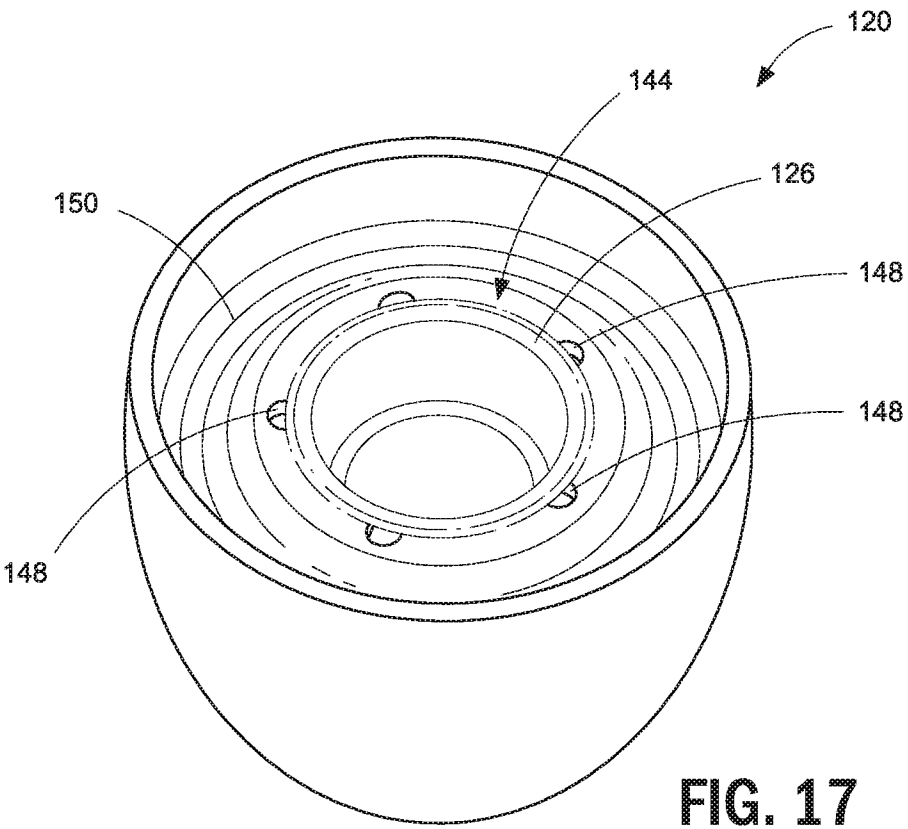
FIG. 17 is a perspective view of a bowl in which the vapor-producing substance container is unitarily-formed with a remainder of the bowl.

FIG. 9 illustrates a package 170 containing a plurality of vapor-producing substance containers 126. The package 170 can be of any suitable arrangement, such as a cardboard container, for example. The package 170 can contain any suitable number of vapor-producing substance containers 126 for commercial or consumer sale, such as 6, 8, 12, 18, 24, 48 or more containers 126, for example. Vapor-producing substance containers 126 can also be sold individually. The substance 160 can be provided in other containers, as well. For example, instead of individual use containers, the substance 160 can be provided in a bulk container, such as a bottle, jar or similar container. The bulk container can be used to refill a reusable container similar to the base 162 of the container 126. The reusable container can be more heavy duty than the disposable containers 126. For example, the reusable container can be made from a thicker material (e.g., metal, such as aluminum or steel, stainless steel, or ceramic) and/or a different material than a comparable disposable container 126. Alternatively, the bowl 120 can be configured to include a receptacle for the substance 160, which can be substantially the same shape as the illustrated container 126, as shown in FIG. 17. The receptacle can be integrated or unitary with another portion of the bowl 120 and, in some configurations, can be made of ceramic or metal. The bulk container can provide any suitable number of refills of the reusable container, such as 6, 8, 12, 18, 24, 48 or more, for example.

The vapor-producing substance 160 can be of any suitable formulation. In some configurations, the substance 160 comprises water, gelatin and a flavoring. In some configurations, the substance 160 comprises animal gelatin (in powder form), glycerin ($C_3H_8O_3$), food flavoring substances and/or food color additive, as desired. In some configurations, the substance 160 includes an odor or fragrance that is dispersed during use of the waterpipe 100 as the substance 160 is vaporized. In some configurations, the substance 160 is an edible flavor enhancer in the form of a gel. In some configurations, the substance 160 is a tobacco and nicotine-free product that can generate satisfaction through the vapor atmosphere, which gives the feel of an ordinary waterpipe. In some configurations, the substance 160 provides an aromatic smell and pure flavor that are generated without the harmful effects of tobacco combustion. In some configurations, the substance 160 can contain nicotine, *cannabis* (or related or similar substances), alcohol, menthol or other substances.

In some configurations, the substance 160 is classified as edible product. In some arrangements, the substance 160 is configured (e.g., formulated and/or provided in sufficient quantity) to last for at least one hour or more during steady or continuous use. Unlike ordinary tobacco and Mu'assel, which lose their flavor after few minutes of the combustion and start to generate a taste of bitterness and burning, the substance 160 can continue to provide flavor/odor throughout use. In some configurations, the substance 160 contains a natural antibacterial substance, which inhibits or prevents the occurrence of bacteria in the waterpipe and its accessories.

In some configurations, the container 126 or disposable bowl 120 can be constructed from recyclable materials. In addition, the charcoal 132 lasts longer when used with the substance 160 compared to tobacco. The substance 160 can contain any desirable flavor or combination of flavors. The substance 160 can include fruit flavors or other food or spice flavors, such as apple (green and/or red apple), green apple & cherry, green apple & strawberry, watermelon, chocolate, strawberry, strawberry & vanilla, banana, lemon, kiwi, orange, grape, grape & mint, combinations thereof and others.

Figure 10:
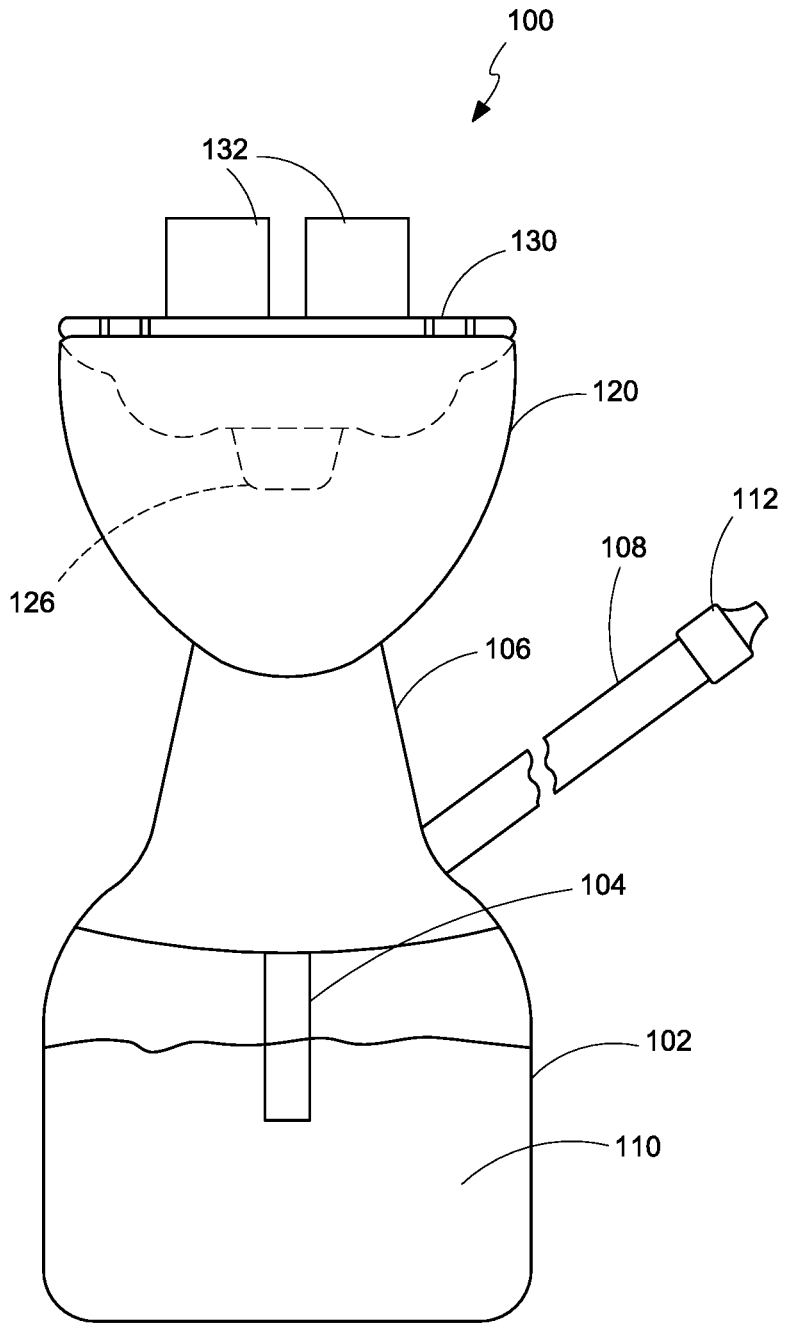
FIG. 10 illustrates a smaller waterpipe that utilizes a disposable or single-use, pre-loaded bowl.

FIG. 10 illustrates another embodiment of a waterpipe 100, which is similar in many respects to the waterpipe of FIG. 1. The waterpipe 100 of FIG. 10 is smaller and more portable than the waterpipe of FIG. 1. However, similar to the prior embodiment, the waterpipe 100 of FIG. 10 includes a base, vase or jar 102. A shaft or stem 104 is supported relative to the base 102 by a cap 106, which can comprise a gasket, grommet or other seal that closes the open top of the base 102. A first end of a hose or tube 108 communicates with an interior of the base 102 at a location above the level of the water 110 within the base 102. A second end of the hose 108 is external of the base 102 and includes a tip 112 that allows a user to inhale vapor from the interior of the base 102. Although not illustrated, waterpipe 100 could also include a purge valve 114 that permits gas to escape the interior of the base 102 when the pressure within the base 102 rises above the ambient or surrounding pressure.

A bowl 120 is supported on the open upper end of the base 102 and an interior of the bowl 120 communicates with the interior of the base 102 via the stem 104. An upper end of the stem 104 can be coupled to the bowl 120 by a bowl gasket or grommet (not shown). A lower end of the stem 104 is positioned within the base 102 below the level of the water 110. Thus, gas and/or vapor in the bowl 120 passes through the stem 104, through the water 110 in the form of or within bubbles and then through the hose 108 to the user. The bowl 120 contains a vapor-producing substance within an interior of the bowl 120. In the illustrated embodiment, the vapor-producing substance is held in a container or receptacle 126 within an interior space of the bowl 120. Preferably, the container 126 is spaced from an upper end of the bowl 120.

A screen, such as a perforated foil sheet 130, is placed over the open upper end of the bowl 120 and supports one or more pieces of charcoal 132, which heats the air within the bowl 120. The heated air within the bowl vaporizes the vapor-producing substance within the container 126. In some configurations, the vapor-producing substance is in the form of a water-containing gel, which can also include flavor and/or odor-producing substances. Thus, rather than smoke from the combustion of tobacco or other similar substances, a user of the illustrated waterpipe 100 inhales water vapor, which can include a flavoring.

Figure 11:
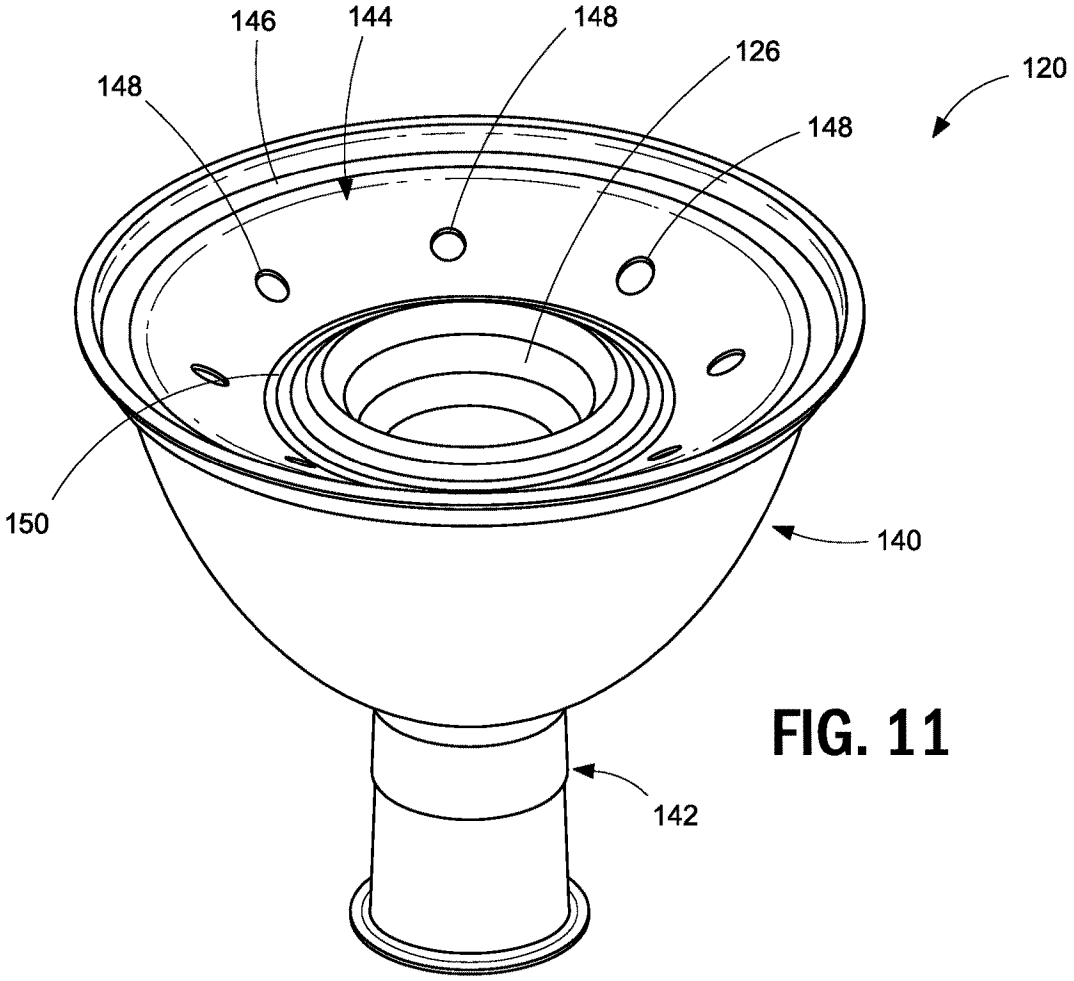
FIG. 11 is a perspective view of the bowl of the waterpipe of FIG. 10.
Figure 12:
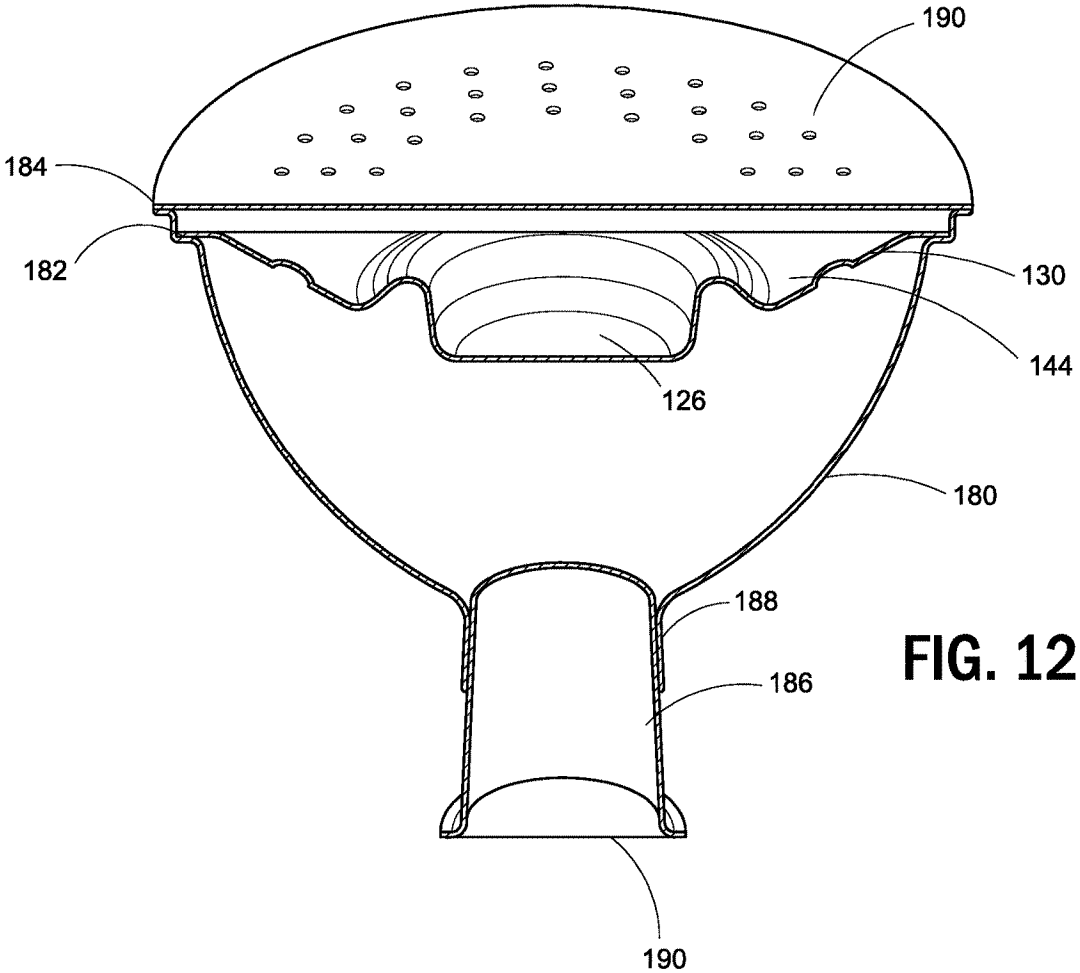
FIG. 12 is a sectional view of the bowl of FIG. 11.
Figure 13:
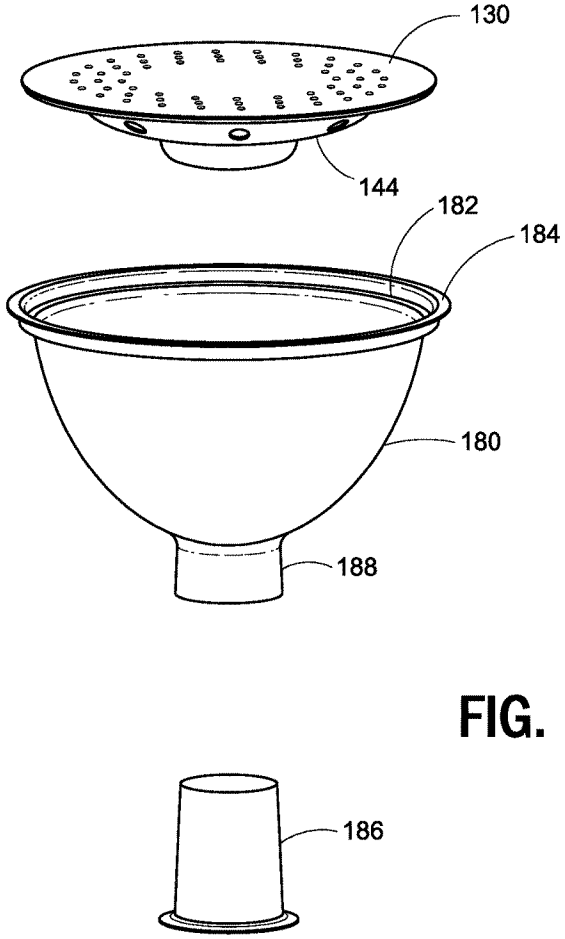
FIG. 13 is an exploded view of the bowl of FIG. 11.

FIGS. 11-13 illustrate the bowl 120 separate from other components of the waterpipe 100. In some configurations, the bowl 120 is a module that can be a replaceable, disposable and/or single-use component of the waterpipe 100. That is, the bowl 120 can be disposed of once the contents of the container or receptacle 126 are consumed or once the user is finished using the bowl 120. The bowl 120 can be substantially similar to the bowls 120 described herein. In particular, the illustrated bowl 120 has an open upper end and an open lower end and includes a sidewall that defines an upper bowl portion 140 and a lower tube portion 142. The lower tube portion 142 of the bowl 120 directly or indirectly couples to the upper end of the stem 104.

As described above, the open upper end of the bowl 120 can be covered with a screen, such as perforated foil 130, which can support coals 132. The foil 130 (FIGS. 12 and 13) can be integrated with the bowl 120 during the manufacture or assembly process in disposable or single-use embodiments.

An interior wall 144 extends at least partially across the hollow interior of the bowl 120 in a direction generally transverse to a longitudinal axis of the sidewall or hollow interior of the bowl 120. The interior wall 144 originates at the outer sidewall of the bowl 120 and extends toward the container or receptacle 126. In the illustrated arrangement, the container or receptacle 126 is unitarily formed with the interior wall 144. However, in other arrangements, the container 126 can be separate from the interior wall 144 and can be arranged in a manner similar to the other bowls 120 disclosed herein. An upper end of the container or receptacle 126 is positioned below the open upper end of the bowl 120 (within the bowl 120). As a result, the vapor-producing substance container or receptacle 126 is spaced from the charcoal 132 held by the perforated foil 130.

The interior wall 144 also includes one or more vents or transfer ports 148 that permit gases to pass from one side of (e.g., above) the interior wall 144 to the other side of (e.g., below) the interior wall 144. In the illustrated arrangement, the transfer ports 148 extend from and are contiguous with the opening 146. In some configurations, the portion of the interior wall 144 that includes the transfer ports 148 is tapered or angled relative to the longitudinal axis of the bowl 120 and extends between an outer rim 146 and the container or receptacle 126.

The interior wall 144 also defines a depression or recess, such as a gutter 150, that can collect coal ash or other sediment carried by air or gases moving through the bowl 120. The illustrated gutter 150 is annular in shape and surrounds the container or receptacle 126. In the illustrated arrangement, the gutter 150 is at least partially defined by an inner portion of the interior wall 144 adjacent the container or receptacle 126. However, in other configurations the gutter 150 can be adjacent the sidewall of the bowl 120. In cross-section, the gutter 150 can be of any suitable shape or depth.

The bowl 120 can be of any suitable construction and any suitable material or combination of materials to be disposable. For example, the bowl 120 can be constructed from formed sheet(s) of a thin metal material such that the bowl 120 can withstand the heat applied to vaporize the contents of the container or receptacle 126 for the time period needed to consume the contents of the container or receptacle 126. With reference to FIGS. 12 and 13, the bowl 120 can comprise an outer wall portion 180 that is formed generally in the shape of a bowl with an open upper end and an open lower end. The lower end is substantially smaller in diameter (or cross-sectional dimension) relative to the upper end. The upper end of the outer wall portion 180 comprises a shelf 182 and an outer rim 184. The shelf 182 is inward of and below the rim 184.

The interior wall 144 is a separate piece from the outer wall portion 180 and is supported on the shelf 182. If desired, the interior wall 144 can be secured to the outer wall portion 180 by any suitable arrangement. For example, the interior wall 144 can be press-fit within the outer wall portion 180. Similarly, the perforated foil 130 is a separate piece of material that can be secured to the interior wall 144 or outer wall portion 180 by any suitable arrangement. For example, the perforated foil 130 can be secured to the interior wall 144 (after the container or receptacle 126 is filled) and then the foil 130/wall 144 assembly inserted into the outer wall portion 180. Alternatively, the foil 130 can be inserted after the interior wall 144. Other suitable methods can also be used.

The lower tube portion 142 can be defined partially by the outer wall portion 180 and partially by a separate tube member 186. For example, the outer wall portion 180 can comprise a lower flange 188 and the tube member 186 can be coupled to the flange 188. In the illustrated arrangement, the tube member 186 is positioned within the flange 188, such as press-fit within the flange 188, for example. However, other methods or arrangements can also be used. The lower tube portion 142 can couple to the stem 104. In alternative arrangements, the lower tube portion 142 could form the stem 104.

Preferably, at least in arrangements intended to be disposable, the upper and lower ends of the bowl 120 are closed for storage purposes until the bowl 120 is to be used. Any suitable type of cap or closure can be used to close the bowl 120. In the illustrated arrangement, removable seals 190 are used to close the upper and lower ends of the bowl 120 until use. The seals 190 can be adhesively secured to rims or other portions of the upper and lower ends of the bowl 120.

Figure 14:
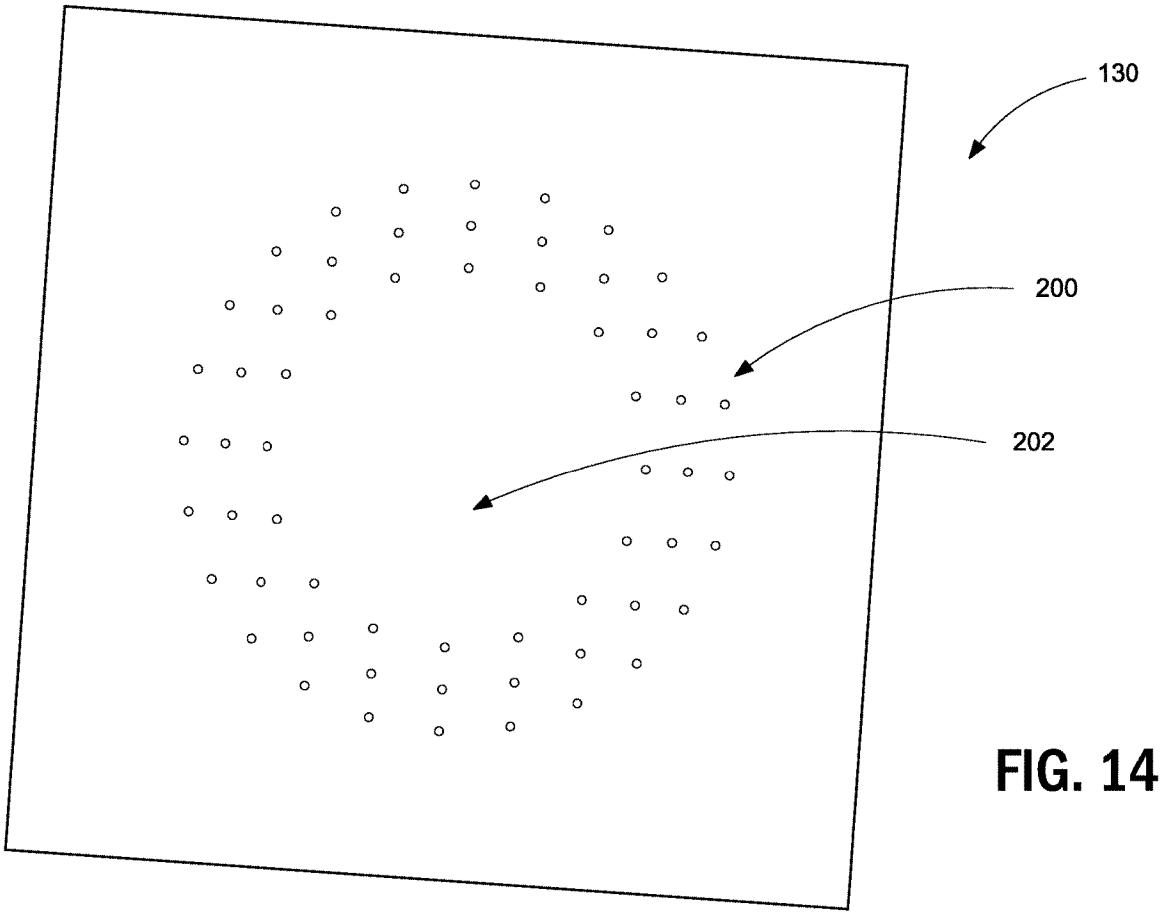
FIG. 14 illustrates a square perforated foil sheet.
Figure 15:
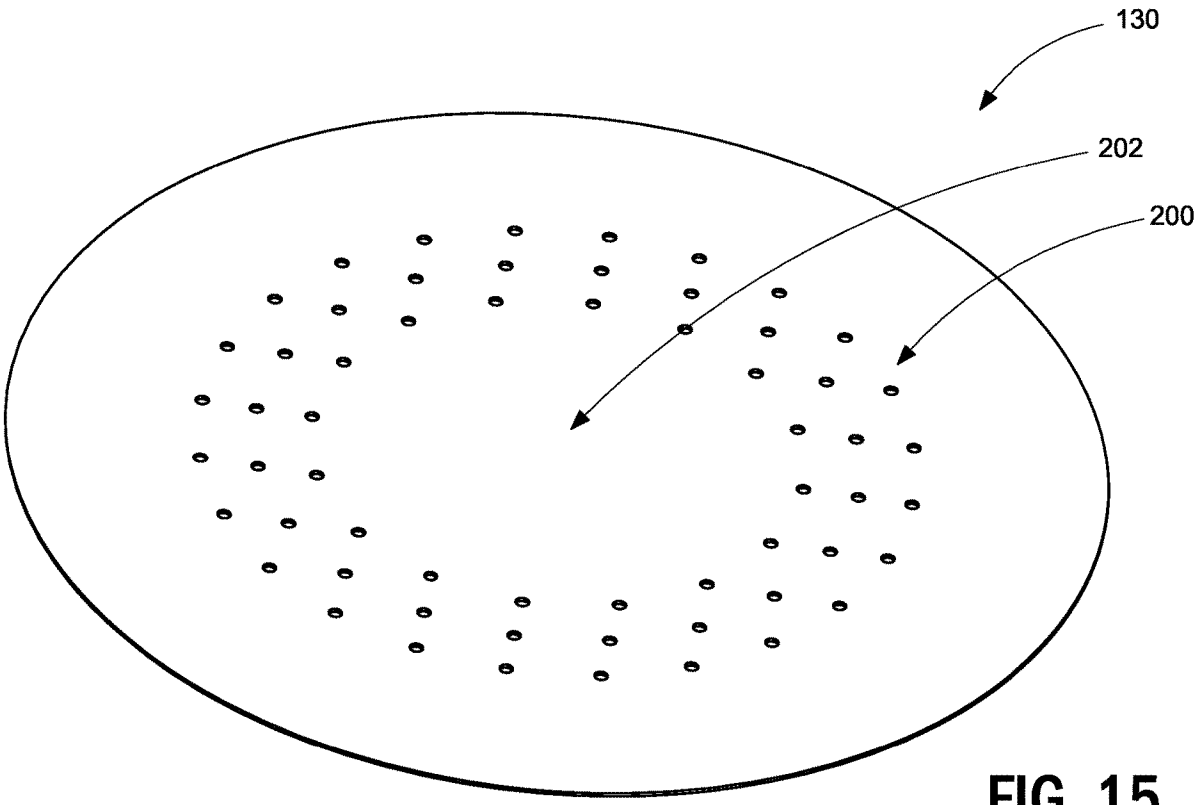
FIG. 15 illustrates a circular perforated foil sheet.

FIGS. 14 and 15 illustrate perforated foils 130 that can be used with the bowls 120 disclosed herein. The foil 130 of FIG. 14 is square in shape and the foil 130 of FIG. 15 is circular in shape. The foil 130 of FIG. 14 can be suitable for use with the bowls 120 intended to be reusable, as the corners of the square foil 130 can be folded over the bowl 120 to secure the foil 130 to the bowl 120. The circular foil 130 of FIG. 15 can also be used with bowls 120 intended to be reusable. In such arrangements, the diameter of the foil 130 preferably is greater than the diameter of the bowl 120 such that the periphery of the foil 130 can be folded over the bowl 120. However, the circular foil 130 can also be used with the bowl 120 of FIGS. 11-13, as described above.

Preferably, the perforated portions 200 of the foils 130 are annular in shape or otherwise positioned on the peripheral portions of the foils 130 such that center portions 202 of the foils 130 are solid or do not include perforations. As a result, the charcoal 132 can be placed on the solid center portions of the foils 130 to reduce or minimize the amount of coal ash that is drawn into the bowl 120 through the perforated portions 200 of the foils 130. As described above, the bowls 120 can include gutters 150 that generally correspond with the location of the perforated portions 200 such that the gutters 150 collect coal ash or other sediment. In some configurations, the foils 130 are perforated during the manufacturing process and packaged for sale to the consumer in a pre-perforated condition.

Figure 16:
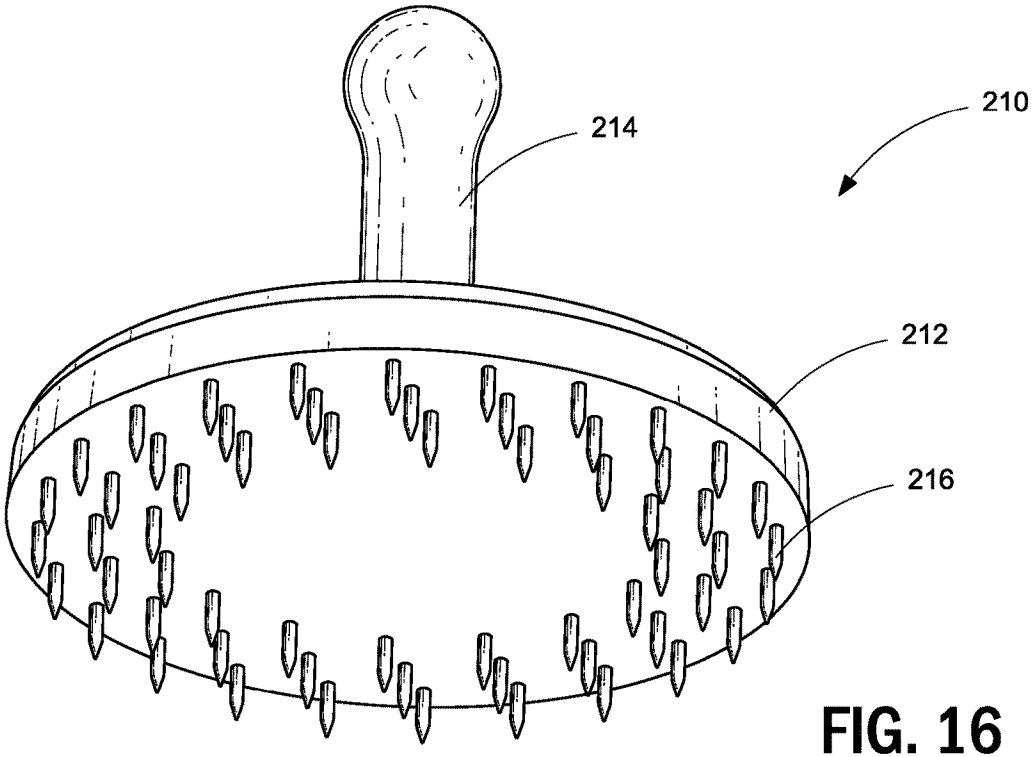
FIG. 16 is a perspective view of a foil sheet perforating tool.

FIG. 16 illustrates a perforating tool 210 that can be used to create an annular perforated portion as illustrated in the foils 130 of FIGS. 14 and 15. The tool 210 includes a base 212, a handle 214 extending from the base 212 and a plurality of punches or spikes 216 arranged in an annular configuration extending from the opposite side of the base 212 from the handle 214. In the illustrated arrangement, the handle 214 is generally cylindrical in shape and extends along a longitudinal axis of the tool 210. However, other suitable handle arrangements could also be used, such as a U-shaped handle in which a handgrip portion of the handle is generally parallel with the base 212. The spikes 216 can be constructed from a metal material. The base 212 and handle 214 can be unitarily formed from a plastic material. In some configurations, the base 212 and handle 214 are overmolded around the spikes 216.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A disposable bowl for a waterpipe, comprising:

an outer wall portion extending between an open lower end and an open upper end of the bowl;

an interior wall portion defining an annular outer portion and a receptacle, the annular outer portion extending inwardly from the outer wall portion in a direction generally transverse to a longitudinal axis of the bowl towards the receptacle, wherein the receptacle comprises a side wall portion and a bottom wall portion, wherein the side wall portion extends generally parallel to the longitudinal axis toward the open lower end of the outer wall portion and the bottom wall portion closes a lower end of the receptacle, the receptacle containing a vapor-producing substance, wherein the receptacle and the substance are spaced from the open upper end of the bowl;

an annular gutter located in the interior wall portion between the outer wall portion and the receptacle and surrounding the receptacle;

one or more transfer ports configured to permit gases to pass from an upper space above the interior wall portion to a lower space below the interior wall portion, wherein the lower space is in gaseous communication with the open lower end such that the gases within the lower space can exit the bowl through the open lower end, wherein the one or more transfer ports are located in the gutter;

a first removable closure closing the open upper end; and a second removable closure closing the open lower end.

2. The disposable bowl of claim 1, further comprising a perforated screen extending above the receptacle.

3. The disposable bowl of claim 1, wherein the gutter is adjacent the receptacle.

4. A bowl for receiving a water-based, vapor-producing tobacco alternative substance, the bowl configured for use with a waterpipe, the bowl comprising:

an upper bowl portion having a bowl-shaped outer wall, the outer wall of the bowl portion defining an open upper end;

a lower tube portion connected to the upper bowl portion, an interior space of the lower tube portion in gaseous communication with an interior space of the upper bowl portion;

an interior wall spaced below the open upper end of the upper bowl portion and above the lower tube portion, the interior wall having an outer peripheral portion that extends from the outer wall of the bowl portion inwardly toward a center longitudinal axis of the bowl;

a receptacle for receiving the substance, the receptacle having a solid sidewall that extends from the outer peripheral portion of the interior wall in a direction toward the lower tube portion, the receptacle having a solid bottom wall that completely closes a lower end of the sidewall such that the substance can be contained within the receptacle;

an annular gutter located in the interior wall between the outer wall and the receptacle and surrounding the receptacle;

one or more transfer ports extending through the interior wall and configured to permit gases to pass from above the interior wall to below the interior wall, wherein the one or more transfer ports are located in the gutter.

5. The bowl of claim 4, wherein the bottom wall portion of the receptacle is spaced below the outer peripheral portion of the interior wall.

6. The bowl of claim 4, wherein the outer peripheral portion of the interior wall, the gutter and the receptacle are unitarily-formed.

7. The bowl of claim 6, wherein the upper bowl portion is unitarily-formed with the outer peripheral portion of the interior wall, the gutter and the receptacle.

8. The bowl of claim 4, wherein the bottom wall portion of the receptacle is spaced below a lowermost extent of the gutter.

* * * * *